US010116081B2

(12) United States Patent
Chae

(10) Patent No.: US 10,116,081 B2
(45) Date of Patent: Oct. 30, 2018

(54) ELECTRICAL OUTLET STRUCTURE

(71) Applicant: Keum-ok Chae, Gyeonggi-do (KR)

(72) Inventor: Keum-ok Chae, Gyeonggi-do (KR)

(73) Assignee: Keum-Ok Chae, Gyeonggi-Do (KR)

( * ) Notice: Subject to any disclaimer, the term of this patent is extended or adjusted under 35 U.S.C. 154(b) by 0 days.

(21) Appl. No.: 15/545,490

(22) PCT Filed: Jan. 21, 2016

(86) PCT No.: PCT/KR2016/000658
§ 371 (c)(1),
(2) Date: Jul. 21, 2017

(87) PCT Pub. No.: WO2016/117943
PCT Pub. Date: Jul. 28, 2016

(65) Prior Publication Data

US 2018/0006394 A1 Jan. 4, 2018

(30) Foreign Application Priority Data

Jan. 23, 2015 (KR) ..... 10-2015-0011432

(51) Int. Cl.
*H01R 13/652* (2006.01)
*H01R 13/447* (2006.01)
(Continued)

(52) U.S. Cl.
CPC ..... *H01R 13/447* (2013.01); *H01R 13/502* (2013.01); *H01R 31/06* (2013.01); *H01R 25/006* (2013.01)

(58) Field of Classification Search
CPC ..... H01R 13/4532; H01R 13/447; H01R 23/688; H01R 23/6873; H01R 13/648; H01R 13/652; H01R 24/22; H01R 24/30
(Continued)

(56) References Cited

U.S. PATENT DOCUMENTS 3,982,804 A * 9/1976 Marechal ..... H01R 13/645 439/139
4,203,640 A * 5/1980 Bice ..... H01R 13/4532 439/139
(Continued)

FOREIGN PATENT DOCUMENTS

FR 984596 A 7/1951
GB 2390491 A 1/2004
(Continued)

OTHER PUBLICATIONS

International Search Report for PCT/KR2016/000658.
(Continued)

*Primary Examiner* — Gary Paumen
(74) *Attorney, Agent, or Firm* — The PL Law Group, PLLC

(57) ABSTRACT

An electrical outlet structure includes an electrical outlet body having four plug terminal insertion holes formed in a front surface thereof, and a blocking panel which has two plug terminal through holes, and is installed on the front surface of the electrical outlet body to block the four plug terminal insertion holes. The user may easily insert the plug into the plug terminal insertion hole installed in a diagonal direction without the user directly having to visually check a direction in which the plug terminal insertion hole of the electrical outlet body is installed, as well as select the insertion direction of the plug into the electrical outlet body as necessary, in consideration of a use state and a surrounding environment of other adjacent electrical outlet bodies.

5 Claims, 6 Drawing Sheets

(51) Int. Cl.
*H01R 13/502* (2006.01)
*H01R 31/06* (2006.01)
*H01R 25/00* (2006.01)

(58) Field of Classification Search
USPC ..... 439/139, 138, 108, 101
See application file for complete search history.

(56) References Cited

U.S. PATENT DOCUMENTS 5,066,238 A * 11/1991 Shieh ..... H01R 13/4532 439/137
5,096,432 A * 3/1992 Cullen ..... H01R 13/4532 439/137
5,685,727 A * 11/1997 Cairns ..... G02B 6/3816 385/56
5,697,798 A * 12/1997 Marechal ..... H01R 13/4532 439/139
5,865,633 A * 2/1999 Hou, Jr. ..... H01R 13/4532 439/139
5,902,140 A * 5/1999 Cheung ..... H01R 13/4532 174/67
6,015,306 A * 1/2000 Jen ..... H01R 13/4532 439/139
6,257,908 B1 * 7/2001 Le ..... H01R 13/4532 439/139
6,364,673 B1 * 4/2002 Lee ..... H01R 13/4532 174/67
7,273,384 B1 9/2007 O
2004/0009689 A1 * 1/2004 Wang ..... H01R 13/5213 439/139

FOREIGN PATENT DOCUMENTS

JP 2003-068388 A 3/2003
JP 2005-026131 A 1/2005
KR 20-1998-0066934 U 12/1998
KR 20-0142700 Y1 6/1999
KR 20-0184537 Y1 6/2000
KR 10-2004-0072756 A 8/2004
KR 20-2008-0001280 U 5/2008
KR 10-0957534 B1 5/2010

OTHER PUBLICATIONS

Office action dated May 29, 2018 from Japan Intellectual Property Office in a counterpart Japanese Patent Application No. 2017-538693.
European Search Report for EP16740416.9 from European patent office in a counterpart European patent application dated Aug. 22, 2018.

* cited by examiner

ELECTRICAL OUTLET STRUCTURE

CROSS REFERENCE TO RELATED APPLICATIONS AND CLAIM OF PRIORITY

This application claims benefit under 35 U.S.C. 119(e), 120, 121, or 365(c), and is a National Stage entry from International Application No. PCT/KR2016/000658, filed Jan. 21, 2016, which claims priority to the benefit of Korean Patent Application No. 10-2015-0011432 filed in the Korean Intellectual Property Office on Jan. 23, 2015, the entire contents of which are incorporated herein by reference.

TECHNICAL FIELD

The present invention relates to an electrical outlet structure, and more particularly, to an electrical outlet structure that allows a user to easily insert a plug into plug terminal insertion holes installed in a diagonal direction without the user having to directly check a direction in which the plug terminal insertion holes of an electrical outlet body are installed with eyes, as well as select an insertion direction of the plug into the electrical outlet body as necessary, in consideration of a use state and a surrounding environment of other adjacent electrical outlet bodies.

BACKGROUND ART

FIG. 1 is a view illustrating a configuration of an electrical outlet structure of the related art. As illustrated in FIG. 1, an electrical outlet structure 10 of the related art has two plug terminal insertion holes 11 which are provided in each plug insertion hole 13 into which a plug is inserted, and are installed in an inclined state in a diagonal direction similar to each other.

That is, the electrical outlet structure 10 of the related art in FIG. 1 has been proposed so as to allow a user to use four plug insertion holes 13 at the same time, as illustrated in FIG. 2, without interference due to cords 25 of plugs 20 inserted into the respective plug insertion holes 13.

Nevertheless, due to the cord 25 of the plug 20 inserted in an upper right portion in FIG. 2, the user experiences inconvenience when inserting the plug 20 into the plug insertion hole 13 at a lower left side, and even when the plug 20 is additionally inserted into the plug insertion hole 13 at a lower right side, the plug cord 25 inserted in the upper right portion is placed on the plug 20 inserted in the lower left portion, and subsequently, causing inconvenience for the user to remove the plug 20 inserted in the lower left portion.

In addition, since the electrical outlet structure 10 is usually installed at a lower section of a wall, or in a state of being covered with a furniture or the like, when the user tries to insert the plug 20 into the plug terminal insertion holes 11 provided in the inclined state as illustrated in FIG. 1, the user often cannot visually check the inclination direction and inclination angle of the plug terminal insertion holes 11.

Therefore, the user may frequently fail when trying to insert the plug 20 in a state in which the plug 20 is inclined while predicting the inclination direction and inclination angle of the plug terminal insertion holes 11.

Accordingly, the user has the inconvenience of inserting the plug 20 in a state of hanging down his/her head to a position where the electrical outlet structure 10 is installed in order to directly check the plug terminal insertion holes 11 with eyes.

However, since the electrical outlet structure 10 may be covered with the furniture or the like, it is necessary to insert the plug 20 by predicting the inclination direction and the inclination angle of the plug terminal insertion holes 11 while the user reaches his/her hand to a back side of the furniture. In this case, the user cannot put his/her head into a space between the electrical outlet structure 10 and the furniture, such that the user frequently gives up on the insertion of the plug 20 without plugging it into the electrical outlet.

Conventionally, in order to prevent an occurrence of an electric shock accident by inserting a finger or a chopstick into the plug terminal insertion hole 11 by children, an electrical outlet cover that can integrally cover the plug terminal insertion holes 11 and the plug insertion hole 13 has been proposed. However, such an electrical outlet cover has a problem of losing the original function of the electrical outlet, and in order to use the electrical outlet again, it is inconvenient for the user to disconnect the electrical outlet cover from the electrical outlet.

SUMMARY

Accordingly, it is an object of the present invention to provide an electrical outlet structure that allows a user to easily insert a plug into plug terminal insertion holes installed in a diagonal direction without the user having to directly check a direction in which the plug terminal insertion holes of an electrical outlet body are installed with eyes, as well as select an insertion direction of the plug into the electrical outlet body as necessary, in consideration of a use state and a surrounding environment of other adjacent electrical outlet bodies.

In order to achieve the above-described object, an electrical outlet structure according to the present invention may include: an electrical outlet body which includes four plug terminal insertion holes formed in a front surface thereof; and a blocking panel which includes two plug terminal through holes, and is installed on the front surface of the electrical outlet body to block the four plug terminal insertion holes.

Preferably, the blocking panel is configured to be rotated to right or left by an external force applied thereto with being installed on the front surface of the electrical outlet body, such that a pair of plug terminal insertion holes of the four plug terminal insertion holes are exposed to an outside through the two plug terminal through holes.

In addition, the electrical outlet structure may further include a restoring member configured to again block the four plug terminal insertion holes by the blocking panel due to the blocking panel being rotated in a reverse direction when the external force is removed.

Further, when the blocking panel is restored by the restoring member, the two plug terminal through holes may be located side-by-side in a horizontal direction.

In particular, when the blocking panel 180 is restored by the restoring member, the two plug terminal through holes 185 are located side-by-side in a horizontal direction.

Furthermore, the electrical outlet body 150 may have power lines 200 installed on a rear surface thereof, and the power lines 200 may be exposed to an outside through the four plug terminal insertion holes 110.

Furthermore, the electrical outlet body 150 may include a ground wire 250 provided on an upper surface thereof, and the blocking panel 180 may include a ground connection part 350 provided on a rear surface thereof to contact with the ground wire 250.

According to the present invention, the user may easily insert the plug into the plug terminal insertion hole installed in a diagonal direction without the user directly having to visually check a direction in which the plug terminal insertion hole of the electrical outlet body is installed, as well as select the insertion direction of the plug into the electrical outlet body as necessary, in consideration of a use state and a surrounding environment of other adjacent electrical outlet bodies.

In addition, according to the present invention, there is provided an electrical outlet structure capable of normally blocking the insertion of foreign matters into the plug terminal insertion holes, without requiring the user to remove the same individually for using the electrical outlet.

DETAILED DESCRIPTION

Figure 1:
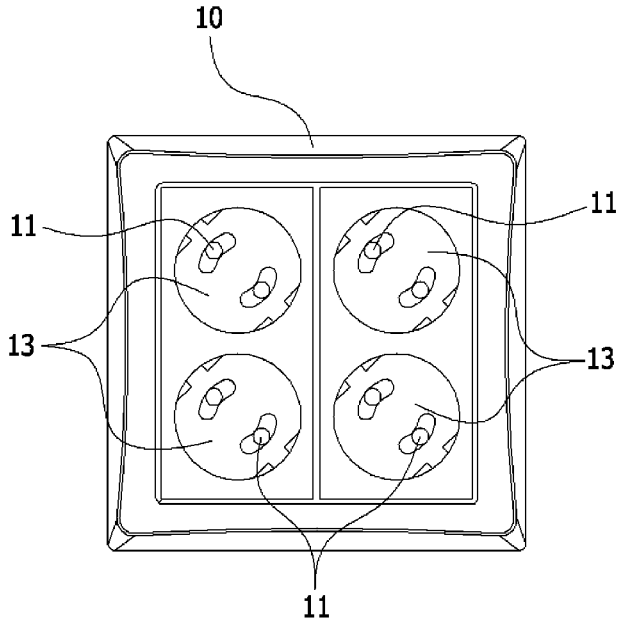
FIG. 1 is a view illustrating a configuration of an electrical outlet structure of the related art.

Hereinafter, the present invention will be described with reference to the accompanying drawings in detail. Referring to the drawings, wherein like reference characters designate like or corresponding parts throughout the several views. In the embodiments of the present invention, the publicly known functions and configurations that are judged to be able to make the purport of the present invention unnecessarily obscure will not be described.

Figure 3:
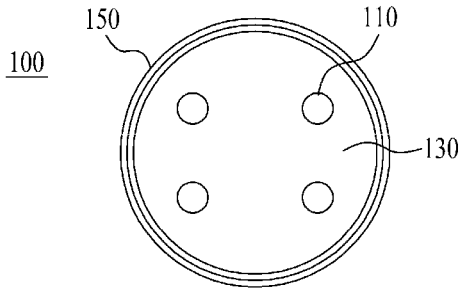
FIG. 3 is a view illustrating an outer appearance of an electrical outlet structure according to one embodiment of the present invention.

FIG. 3 is a view illustrating an outer appearance of an electrical outlet structure according to one embodiment of the present invention. As illustrated in FIG. 3, the electrical outlet structure according to one embodiment of the present invention has four plug terminal insertion holes 110 installed in a front surface thereof.

The four plug terminal insertion holes 110 are formed by two pairs of plug terminal insertion holes 110. The user may select a pair of plug terminal insertion holes 110 installed in a diagonal direction among the four plug terminal insertion holes 110, thus to insert a plug therein.

That is, it is preferable that a distance between the pair of plug terminal insertion holes 110 installed in the diagonal direction is the same as a distance in which the plug terminals are separated, and an angle of a line connecting the pair of plug terminal insertion holes 110 is smaller than 45 degrees.

Figure 2:
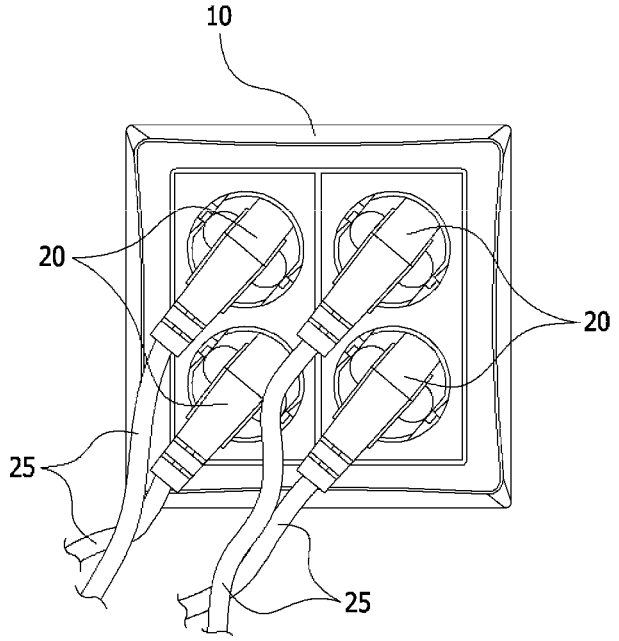
FIG. 2 is a view illustrating a state in which plugs are inserted into the electrical outlet structure of the related art.

Specifically, the angle of the line connecting the pair of plug terminal insertion holes 110 is preferably about 20 to 30 degrees. By forming the angle thereof within the above range, when four electrical outlets are installed while forming a square shape as illustrated in FIG. 2, the cord of the plug inserted into the electrical outlet at the upper right side passes through a space between the electrical outlet at the lower left side and the electrical outlet at the upper left side without passing through the plug insertion hole of the electrical outlet at the lower left side, such that it may not be possible to interfere with the plug to be inserted into the adjacent electrical outlets.

Figure 4:
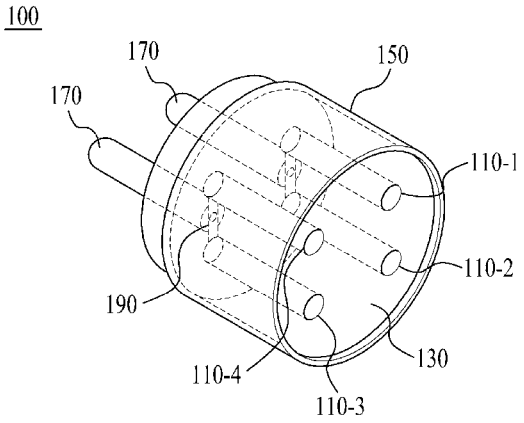
FIG. 4 is a perspective view of the electrical outlet structure according to one embodiment of the present invention.

FIG. 4 is a perspective view of the electrical outlet structure according to one embodiment of the present invention. Referring to FIG. 4, four plug terminal insertion holes 110 provided in the electrical outlet structure according to one embodiment of the present invention include a first terminal insertion hole 110-1, a second terminal insertion hole 110-2, a third terminal insertion hole 110-3, and a fourth terminal insertion hole 110-4.

The first terminal insertion hole 110-1 and the third terminal insertion hole 110-3 form a pair of plug terminal insertion holes 110 into which the plug terminals are inserted in a first diagonal direction, and the second terminal insertion hole 110-2 and the fourth terminal insertion hole 110-4 form a pair of plug terminal insertion holes 110 into which the plug terminals are inserted in a second diagonal direction.

A conduction member 190 is installed between the first terminal insertion hole 110-1 and the fourth terminal insertion hole 110-4 to receive power from a power supply. Therefore, the power supplied to the conduction member 190 is supplied to one terminal of the plug terminals selectively inserted into the first terminal insertion hole 110-1 or the fourth terminal insertion hole 110-4.

In addition, another conduction member 190 is also provided between the second terminal insertion hole 110-2 and the third terminal insertion hole 110-3, such that the power supplied to the conduction member 190 is supplied to the other terminal of the plug terminals selectively inserted into the second terminal insertion hole 110-2 or the third terminal insertion hole 110-3.

Meanwhile, the electrical outlet structure according to the present invention may be embedded in a building wall at the time of constructing the building, but it may be installed in such a manner that the electrical outlet body 150 in FIG. 4 is additionally inserted into the plug terminal insertion holes 110 of the electrical outlet as illustrated in FIG. 1, which has been already embedded in the wall of the building.

For this purpose, it is preferable that the electrical outlet structure according to the present invention includes a pair of coupling terminals 170 on a rear surface thereof, which are connected to a central portion of each of the conduction members 190. The pair of coupling terminals 170 are inserted into the plug terminal insertion holes 11 of the previously installed electrical outlet as illustrated in FIG. 1, and in this state, the power is supplied to the first terminal insertion hole 110-1 to the fourth terminal insertion hole 110-4 through the conduction member 190.

Figure 5:
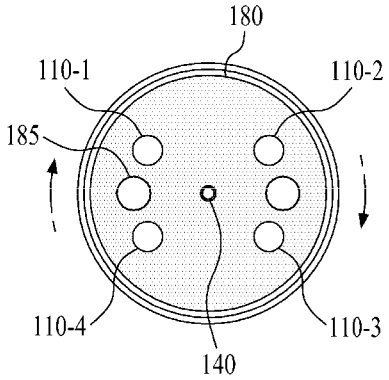
FIG. 5 is a view illustrating a configuration of an electrical outlet structure according to another embodiment of the present invention.

FIG. 5 is a view illustrating a configuration of an electrical outlet structure according to another embodiment of the present invention. Referring to FIG. 5, the electrical outlet structure according to another embodiment of the present invention further includes a blocking panel 180 which is installed on the front surface of the electrical outlet body 150 according to one embodiment of the present invention, thereby performing a function to block the four plug terminal insertion holes 110 provided in the electrical outlet body 150.

Specifically, the circular blocking panel 180 made of a non-conductive material such as plastic has a pair of plug terminal through holes 185 formed in a central portion of the blocking panel 180 flush with each other in a spaced-apart state with a predetermined interval. The blocking panel 180 is installed on the front surface of the electrical outlet body 150 through a fastening member 140.

Accordingly, the blocking panel 180 may block the four plug terminal insertion holes 110 formed in the electrical outlet body 150, and thereby, it is possible to prevent children from inserting a finger or chopstick into the plug terminal insertion hole 110, as well as prevent foreign matters from being inserted into the plug terminal insertion holes 110.

Meanwhile, a distance between the pair of spaced apart plug terminal through holes 185 should be the same as the distance between the pair of spaced apart plug terminal insertion holes 110 arranged in the diagonal direction.

In addition, to implement the present invention, the fastening member 140 is made of an elastic material such as a spring. Thereby, as illustrated in FIGS. 6 and 7, it is preferable that the electrical outlet structure allows the user to insert the plug terminals in a state in which the pair of plug terminal insertion holes 110 among the four plug terminal insertion holes 110 are exposed to an outside.

In other words, in a state in which no external force is applied by the user, the blocking panel 180 is in a normal position state illustrated in FIG. 5, and thereby, the user usually predicts that the plug terminal through holes 185 of the blocking panel 180 are located in a horizontal direction.

Therefore, the user may easily insert the plug terminals into the plug terminal through holes 185 in FIG. 5 without looking with the eyes. However, in this state, the user cannot insert the plug terminals into the plug terminal insertion holes 110 of the electrical outlet body 150.

Figure 6:
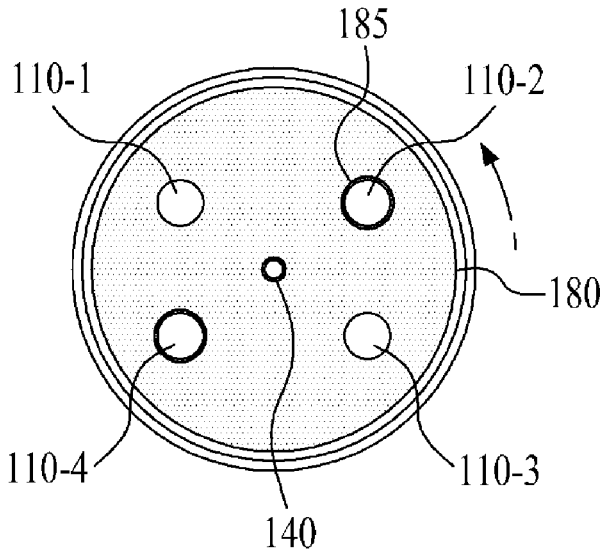
FIGS. 6 and 7 are views illustrating a use state of the electrical outlet structure in FIG. 5.
Figure 7:
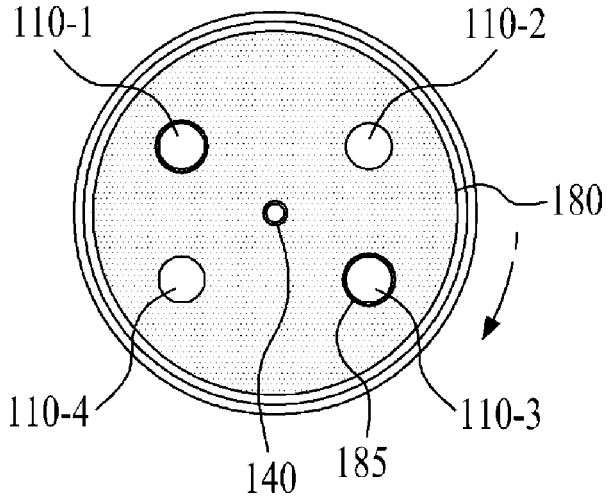

Accordingly, the user applies a slight pressure toward the electrical outlet body 150 in a state in which the plug terminals are inserted into only the plug terminal through holes 185, and rotates the blocking panel 180 by twisting a wrist thereof in a user's desired direction as illustrated in FIGS. 6 and 7.

When the plug terminal through holes 185 come to the same position as the plug terminal insertion holes 110 of the electrical outlet body 150 as the blocking panel 180 is rotated, the plug with a slight pressure applied thereto toward the electrical outlet body 150 passes through the plug terminal through holes 185 and the plug terminal insertion holes 110 to be inserted therein.

As described above, by using the blocking panel 180 installed in a forward direction as illustrated in FIG. 5, the user may easily insert the plug into the plug terminal insertion holes 110 installed in the diagonal direction without the user having to directly check a direction in which the plug terminal insertion holes 110 of the electrical outlet body 150 are installed with eyes, as well as select an insertion direction of the plug into the electrical outlet body 150 as necessary, in consideration of a use state and a surrounding environment of other adjacent electrical outlet bodies 150.

Meanwhile, when the external force applied to the blocking panel 180 is removed by pulling the plug from the electrical outlet body 150, the blocking panel 180 is again returned to a regular position illustrated in FIG. 5 by an elastic restoring force exerted by the fastening member 140. Thereby, the electrical outlet structure waits until reuse by the user, and normally performs the blocking function of the plug terminal insertion holes 110.

Figure 8:
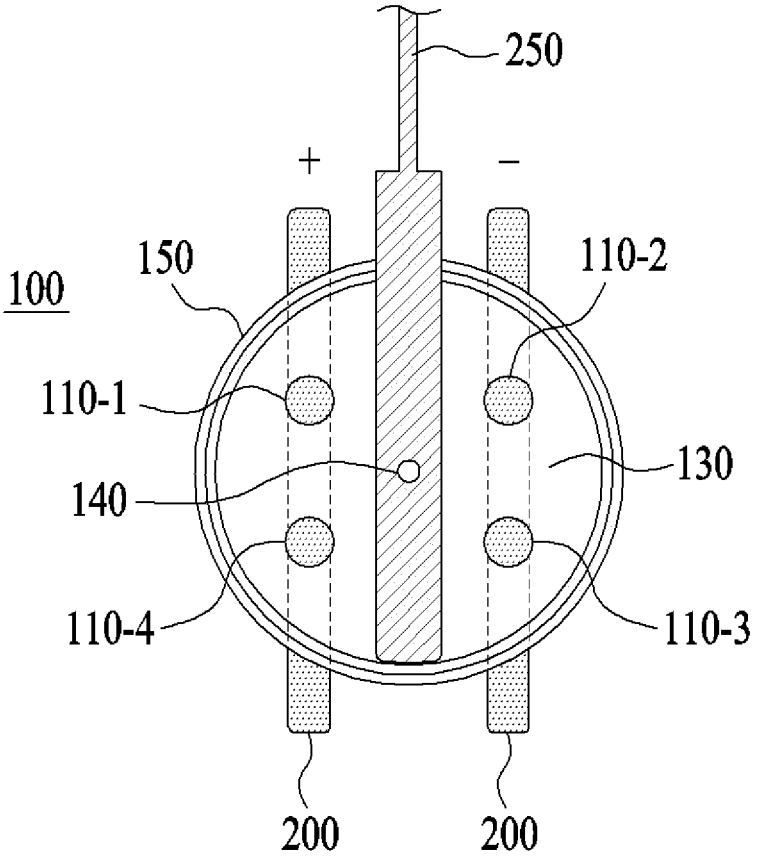
FIG. 8 is a view illustrating a wiring structure in the electrical outlet structure according to another embodiment of the present invention.

FIG. 8 is a view illustrating a wiring structure in an electrical outlet structure 100 according to another embodiment of the present invention. Referring to FIG. 8, an electrical outlet body 150 in the electrical outlet structure 100 according to another embodiment of the present invention has a pair of power lines 200 installed therein. Herein, the pair of power lines 200 are located on the rear surface of the electrical outlet body 150.

Specifically, a first terminal insertion hole 110-1 and a fourth terminal insertion hole 110-4 are located on the power line 200 of a positive pole, and a second terminal insertion hole 110-2 and a third terminal insertion hole 110-3 is located on the power line 200 of a negative pole.

The power lines 200 are exposed to an upper portion of the electrical outlet body 150 through the first terminal insertion hole 110-1, the second terminal insertion hole 110-2, the third terminal insertion hole 110-3, and the fourth terminal insertion hole 110-4. Thereby, in both of a case in which the plug terminals are inserted into the first terminal insertion hole 110-1 and the third terminal insertion hole 110-3 as illustrated in FIG. 7, and a case in which the plug terminals are inserted into the second terminal insertion hole 110-2 and the fourth terminal insertion hole 110-4 as illustrated in FIG. 6, the plug terminals may receive the power through the power lines 200.

In addition, a rectangular ground wire 250 is installed on the upper surface of the electrical outlet body 150. The ground wire 250 is in electrical contact with a rectangular ground connection part 350 installed on the rear surface of the blocking panel 180 in FIGS. 9 and 10.

Figure 9:
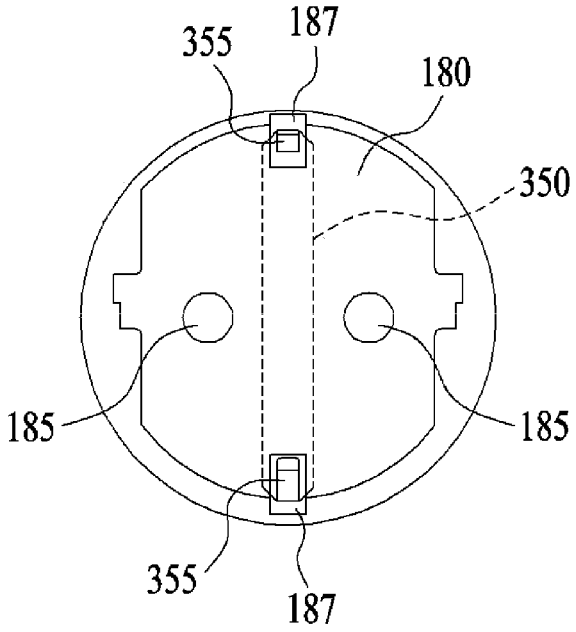
FIG. 9 is a view illustrating an upper structure of a blocking panel in the electrical outlet structure according to another embodiment of the present invention.
Figure 10:
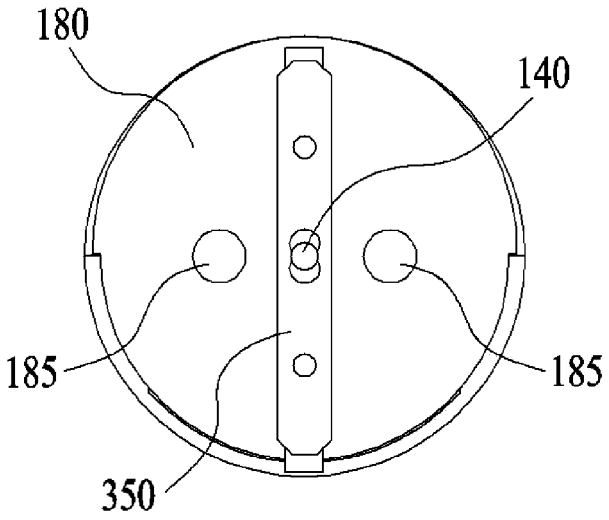
FIG. 10 is a view illustrating a lower structure of the blocking panel in the electrical outlet structure according to another embodiment of the present invention.

Specifically, as illustrated in FIGS. 9 and 10, the rectangular ground connection part 350 is installed on the rear surface of the blocking panel 180. As the blocking panel 180 in FIG. 9 is coupled to the fastening member 140 of the electrical outlet body 150 in FIG. 8, the ground wire 250 and the ground connection part 350 electrically contact with each other.

Meanwhile, in the coupled state as described above, even when the blocking panel 180 is rotated from side to side as illustrated in FIGS. 6 and 7, the ground wire 250 and the ground connection part 350 maintain the electrically connected state therebetween while maintaining the intersection state about the fastening member 140 of a fixed pin manner.

Further, as illustrated in FIG. 9, the ground connection part 350 installed on the rear surface of the blocking panel 180 has bent portions 355 formed at opposite ends thereof, which respectively protrude to the upper surface of the blocking panel 180 through ground holes 187 provided at the upper and lower portions of the blocking panel 180.

As described above, the bent portions 355 respectively protruding to the upper and lower portions on the upper surface of the blocking panel 180 contact with ground terminals (not illustrated) provided on the upper and lower sides of the plug inserted into the plug terminal through holes 185, thus to be electrically connected with each other.

Meanwhile, to implement the present invention, in order to stably couple the ground terminals provided on the sides of the plug inserted through the plug terminal through holes 185 of the blocking panel 180 with the bent portions 355 provided at the opposite ends of the ground connection part 350, and stably insert the plug therein, it is preferable that the blocking panel 180 has a cylindrical vertical panel integrally provided on an outer circumference of the blocking panel 180 to guide the insertion of the plug in a vertical direction.

While the present invention has been described with reference to the preferred embodiments and modified examples, the present invention is not limited to the above-described specific embodiments and the modified examples, and it will be understood by those skilled in the related art that various modifications and variations may be made therein without departing from the scope of the present invention as defined by the appended claims, as well as these modifications and variations should not be understood separately from the technical spirit and prospect of the present invention.

In addition, the terminology used herein is for the purpose of describing particular embodiments only and is not intended to limit the present invention thereto. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements, and/or components, but do not preclude the presence or addition of one or more other features, integers, steps, operations, elements, components, and/or groups thereof.

The present invention can be applied to electric equipment, such that industrial applicability thereof may be recognized in the related industrial fields.

The invention claimed is:

1. An electrical outlet structure comprising:

an electrical outlet body which includes four plug terminal insertion holes formed in a front surface thereof; and a blocking panel which includes two plug terminal through holes, and is installed on the front surface of the electrical outlet body to block the four plug terminal insertion holes, wherein the electrical outlet body includes a ground wire provided on an upper surface thereof, and the blocking panel includes a ground connection part provided on a rear surface thereof to contact with the ground wire.

2. The electrical outlet structure according to claim 1, wherein the blocking panel is configured to be rotated to right or left by an external force applied thereto on the front surface of the electrical outlet body, such that a pair of plug terminal insertion holes of the four plug terminal insertion holes are exposed to an outside through the two plug terminal through holes.

3. The electrical outlet structure according to claim 2, further comprising a restoring member configured to again block the four plug terminal insertion holes by the blocking panel due to the blocking panel being rotated in a reverse direction when the external force is removed.

4. The electrical outlet structure according to claim 3, wherein, when the blocking panel is restored by the restoring member, the two plug terminal through holes are located side-by-side in a horizontal direction.

5. The electrical outlet structure according to claim 1, wherein the electrical outlet body has power lines installed on a rear surface thereof, and the power lines are exposed to an outside through the four plug terminal insertion holes.

* * * * *